US006854229B2

(12) United States Patent
Keith et al.

(10) Patent No.: US 6,854,229 B2
(45) Date of Patent: Feb. 15, 2005

(54) FORM TIE SLEEVES FOR COMPOSITE ACTION INSULATED CONCRETE SANDWICH WALLS

(75) Inventors: David O. Keith, American Fork, UT (US); Mark Donaldson, Provo, UT (US)

(73) Assignee: H.K. Marketing LLC, American Fork, UT (US)

( * ) Notice: Subject to any disclaimer, the term of this patent is extended or adjusted under 35 U.S.C. 154(b) by 0 days.

(21) Appl. No.: 10/447,724

(22) Filed: May 29, 2003

(65) Prior Publication Data

US 2004/0237438 A1 Dec. 2, 2004

(51) Int. Cl.[7] ..... E04G 17/08

(52) U.S. Cl. ..... 52/428; 52/426; 52/439; 52/309.12

(58) Field of Search ..... 52/423, 428, 426, 52/431, 439, 568, 309.11, 309.12, 309.17; 249/40, 42

(56) References Cited

U.S. PATENT DOCUMENTS

| | | | | |
|---|---|---|---|---|
| 1,708,634 A | | 4/1929 | Rees | |
| 2,575,079 A | | 11/1951 | Temple | |
| 2,595,123 A | | 4/1952 | Callan | |
| 2,645,929 A | | 7/1953 | Jones | |
| 2,653,469 A | | 9/1953 | Callan | |
| 2,718,138 A | | 9/1955 | Jones | |
| 2,769,333 A | * | 11/1956 | Reintjes | 52/378 |
| 2,775,018 A | | 12/1956 | McLaughlin | |
| 2,964,821 A | | 12/1960 | Meehan | |
| 3,426,494 A | | 2/1969 | Hala | |
| 3,534,395 A | | 10/1970 | Rogers | |
| 3,690,613 A | * | 9/1972 | Shoemaker | 249/40 |
| 3,750,355 A | | 8/1973 | Blum | |
| 3,869,219 A | | 3/1975 | Wilson et al. | |
| 4,829,733 A | | 5/1989 | Long | |
| 3,933,332 A | * | 1/1976 | Lovisa et al. | 249/42 |
| 4,018,023 A | | 4/1977 | Anderson | |
| 4,157,001 A | | 6/1979 | Pickles | |
| 4,329,821 A | | 5/1982 | Long et al. | |
| 4,348,847 A | | 9/1982 | Jukes | |
| 4,393,635 A | | 7/1983 | Long | |
| 4,545,163 A | | 10/1985 | Asselin | |
| 4,598,519 A | * | 7/1986 | Reid | 52/426 |
| 4,624,089 A | | 11/1986 | Dunker | |
| 4,702,053 A | | 10/1987 | Hibbard | |
| 4,726,560 A | * | 2/1988 | Dotson | 249/43 |
| 4,805,366 A | | 2/1989 | Long | |
| 4,829,733 A | | 5/1989 | Long | |

(List continued on next page.)

FOREIGN PATENT DOCUMENTS

| | | |
|---|---|---|
| DE | 20 24 157 | 12/1971 |
| DE | 27 15 277 | 10/1978 |
| DE | P 39 25 780.0 | 2/1991 |

OTHER PUBLICATIONS

Promotion letter by Monowi Mfg. Co. for "Plasti Form System" (published at least as early as Aug. 1998).

*Primary Examiner*—Carl D. Friedman
*Assistant Examiner*—Basil Katcheves
(74) *Attorney, Agent, or Firm*—Workman Nydegger

(57) ABSTRACT

An elongate sleeve tie is used with casting form ties in the manufacture of composite wall structures. The casting form ties and sleeve ties act to secure one or more casting forms in a rigid position relative to an insulating layer positioned between the casting forms during the manufacture of composite wall structures. The casting form tie is received in a central recess of the elongate sleeve tie. Once the composite wall has been formed, the casting form ties may be pulled out of the wall, leaving the elongate sleeve ties in place. Removal of the casting form ties eliminates the thermal bridges that metal casting form ties would otherwise create. At least a portion of the sleeve tie is formed of a material having a high thermal resistance.

23 Claims, 9 Drawing Sheets

U.S. PATENT DOCUMENTS

| | | | | |
|---|---|---|---|---|
| 4,907,928 | A | | 3/1990 | Beck et al. |
| 4,932,819 | A | | 6/1990 | Almeras |
| 4,945,700 | A | | 8/1990 | Powell |
| 5,011,354 | A | | 4/1991 | Brownlee |
| 5,031,378 | A | | 7/1991 | Murphy |
| 5,094,057 | A | | 3/1992 | Morris |
| 5,209,039 | A | | 5/1993 | Boeshart |
| 5,265,998 | A | | 11/1993 | Kluser |
| D357,855 | S | | 5/1995 | Keith et al. |
| 5,497,592 | A | * | 3/1996 | Boeshart ..... 52/699 |
| 5,519,973 | A | | 5/1996 | Keith et al. |
| 5,606,832 | A | | 3/1997 | Keith et al. |
| 5,673,525 | A | | 10/1997 | Keith et al. |
| 5,744,076 | A | | 4/1998 | Baxter |
| 5,809,723 | A | | 9/1998 | Keith et al. |
| 6,138,981 | A | | 10/2000 | Keith et al. |
| 6,263,638 | B1 | * | 7/2001 | Long, Sr. ..... 52/794.1 |

* cited by examiner

FORM TIE SLEEVES FOR COMPOSITE ACTION INSULATED CONCRETE SANDWICH WALLS

BACKGROUND OF THE INVENTION

1. The Field of the Invention

The present invention relates to composite wall structures and, more specifically to the field of connectors used to secure together multiple layers of material within the composite wall structures.

2. The Relevant Technology

As new materials and compositions have been developed, apparently unrelated materials have been synergistically combined to form useful composite materials. One such example is seen in the area of building and construction, in which high strength structural walls have been coated and layered with highly insulative materials which generally have relatively low structural strength. The resulting composite wall structure has high strength and is highly insulative. Conventionally, the structural component of such as a wall is built first, after which the insulating layer or sheet is attached to the structural component. Thereafter a protective cover is placed over the insulating material to protect and hide it. The insulating barrier reduces the transfer of thermal energy across the composite wall structure.

Concrete is one of the least expensive and strongest materials commonly used in the construction industry. Unfortunately, concrete, which is a mixture of hydraulic cement, water, and an aggregate such as rocks, pebbles, and sand, offers relatively poor insulation compared to many other materials. For example, a slab of concrete having an 8 inch thickness has an R value of about 0.64, while a one-inch thick panel of polystyrene has an R value of about 5.0. The R value of a material is proportional to the thermal resistance of the material and is useful for comparing the insulating properties of materials used in the construction industry.

In contrast with concrete, highly insulative materials, at least those of reasonable cost, typically offer poor structural strength and integrity. While lightweight aggregates having higher insulating ability may be incorporated within concrete to increase the insulating effect thereof, the use of such aggregates in an amount that has a dramatic effect on the insulation ability of the concrete will usually result in greatly decreased strength of the resulting structure.

It has been found that positioning at least one concrete layer adjacent to at least one insulating layer provides a composite wall structure that has both good insulating capability and good structural strength. One strategy for forming these composite wall structures is to position an insulating layer between two concrete layers. This technique, however, poses the risk of allowing the two concrete layers to collapse together or to separate apart during construction or subsequent use of the building. Accordingly, it is necessary to structurally bridge or connect the two concrete layers together. This is conventionally accomplished by using metal casting form ties.

Because metal readily conducts thermal energy, metal casting form ties that are used to structurally bridge a pair of structural layers have the effect of significantly reducing the insulating properties of a composite wall. In particular, such casting form ties provide channels through which thermal energy may be conducted. This is true even though the ties may be surrounded by ample amounts of insulating material. Composite wall structures that use metal casting form ties do not prevent heat from flowing from a relatively warm inside wall to a colder outside wall during cold weather, for example, as effectively as composite walls that do not use metal casting form ties. Of course one might construct a building having no structural bridges between the inner and outer structural walls, although the result would be a building having inadequate stability for most needs.

In order to reduce thermal bridging, some have employed casting form ties having a metal portion that passes through the concrete layers and a thermally insulating portion that passes through the insulating layer, e.g., U.S. Pat. No. 4,545,163 to Asselin. Others have developed casting form ties made entirely from polymeric or other highly insulative materials. Examples of the foregoing include U.S. Pat. No. 4,829,733 to Long; U.S. Pat. No. 5,519,973 to Keith et al.; U.S. Pat. No. 5,606,832 to Keith et al.; U.S. Pat. No. 5,673,525 to Keith et al, and U.S. Pat. No. 6,138,981 to Keith et al. For purposes of disclosing insulating casting form ties used to secure a composite wall structure together, each of the foregoing patents are incorporated herein by specific reference.

A common technique for forming composite wall structures is known in the art as the "cast-in-place" method, wherein the wall is formed within vertically positioned casting forms that are erected at or near the location where the composite wall structure is to be finally positioned. In the cast-in-place method the forms and insulating layer are first positioned vertically, after which concrete or other structural material is poured into the spaces between the insulating layer and casting forms. Insulating or metal casting form ties having a length that is more than, equal to or less than the width of the composite wall structure are placed substantially orthogonally through a vertically oriented insulating layer, with the ends of the ties extending out of either surface of the insulating layer.

Composite action, which is well known by those skilled in the art, generally describes how well a multi-layered panel, or composite wall, transfers shear forces between its different layers and is typically identified as a percentage between 0% and 100%. A layered panel having a very high composite action will transfer shear forces very well and will behave like a single laminated panel. Whereas, a layered panel having a very low composite action will not transfer shear forces well and will behave more like a panel having a plurality of disconnected layers. Composite action can provide structural integrity to the wall, although too much composite action in a tall above grade wall may result in too much bowing of the wall because of differential thermal expansion when the inside and outside surfaces of the wall are subjected to different thermal environments. Accordingly, it is generally desirable to produce composite walls having moderately high to high composite action, although the specific composite action desired depends on the wall environment.

BRIEF SUMMARY OF THE INVENTION

The present invention is directed to an elongate sleeve tie to be used with casting form ties in the manufacture of composite wall structures. Casting form ties act to secure one or more casting forms in a rigid position relative to an insulating layer positioned adjacent to and/or between the casting forms during the manufacture of composite wall structures. The casting form tie is received in a central recess of the elongate sleeve tie. Once the composite wall has been formed, the casting form ties may be pulled out of the wall, leaving the elongate sleeve ties in place. At least a portion of the sleeve is formed of a material having a high thermal resistance.

The elongate sleeve tie comprises an elongate sleeve body, which includes a mesial segment, a first anchor segment, a second anchor segment, and a central recess. The mesial segment is positionable through a passage within the insulating layer when the insulating layer is in a desired spaced-apart relationship between two casting forms used to manufacture the composite wall structure. The first and anchor segment is located adjacent to a first side of the mesial segment and is positionable within a first space between the insulating layer and a first casting form. This first space is intended for placement of a hardenable structural material. The second anchor segment is located adjacent to a second side of the mesial segment and is positionable within a second space between the insulating layer and a second casting form. This second space is intended for placement of a hardenable structural material. The central recess is configured to receive a casting form tie that connects the first and second casting forms together during manufacture of the composite wall.

Casting form ties generally include a form retention segment disposed on either side of a central segment. The elongate sleeve tie is positioned over the central segment of the casting form tie in such a way that the tie is at least partially received in the central recess of the elongate sleeve. The mesial segment and anchor segments of the elongate sleeve cover the central segment of the casting form tie, leaving the form retention segments of the casting form tie exposed. During the manufacture of a composite wall structure, the casting form ties are positioned in a manner so that the form retention segments extend through holes within the casting forms, while the mesial segment of the elongate sleeve (covering a portion of the central segment of the casting form tie) extends through an insulating layer positioned within the region defined by the casting forms. The first and second anchor segments of the elongate sleeve tie (covering the remaining portion of the central segment of the casting form tie) occupy the molding spaces that initially exist between the casting forms and the insulating layer. Form locking means attached to each of the form retention segments assist in retaining the forms rigidly spaced apart at a desired distance. The elongate sleeve may further optionally include retention brackets for maintaining the insulating layer in a desired spaced-apart orientation relative to the inner walls of the casting forms.

One or more of the anchor segments may include means for anchoring the elongate sleeve tie within the hardened layer of structural material. Such anchoring means may include, for example, at least one of a recess, a protrusion, or a textured surface. Alternatively, the anchoring means may comprise adhesion means for promoting improved adhesion or bonding between at least one of the anchor segments and the hardened layer of structural material. Examples of adhesion means include an adhesive, a partially cured thermoset resin, or a solvent capable of softening a portion of the elongate sleeve body when applied thereto. In some cases, the inherent bond between cured concrete and plastic without any anchoring structures may be sufficient to retain the sleeve ties anchored sufficiently firmly within the cured concrete structural layer.

After removal of the casting forms, such as by cutting, breaking, separating or otherwise removing the form locking means so that the forms may be separated from the structural layers, the casting form ties may be removed from the composite wall. Once the forms are removed, at least a portion of the form retention segments of the casting form ties protrude from the structural layers. The casting form ties may then be pulled or pushed out of the composite wall and elongate sleeve by, for example, striking the form retention segment with a hammer or chisel and/or pulling the opposite end with pliers or another suitable tool. Because the elongate sleeve tie covers the portion of the casting form tie extending through the composite wall, the casting form tie is easily removed, eliminating the thermal bridge that would otherwise exist.

A composite wall structure is constructed in a cast-in-place method according to a preferred aspect of the invention by first erecting a first casting form. Casting form ties are then inserted through and locked with form locking means to the first casting form. An elongate sleeve is placed over each casting form tie. An insulating layer is positioned in a spaced-apart relationship relative to the first casting form so that the mesial segment of the sleeve body is positioned at least partially within the insulating layer. The first anchor segment of the elongate sleeve body is positioned at least partially within the first molding space. The second casting form is erected in a spaced-apart relationship relative to the insulating layer and a second end of the casting form tie is locked to the second casting form. This results in a second molding space between the second casting form and the insulating layer with the second anchor segment of the elongate sleeve body positioned at least partially within this second space. Retention brackets may optionally be attached to the sleeves to keep the insulating layer in a desired spaced apart orientation between the first and second forms. Concrete or other hardenable structural material is then poured or otherwise introduced within the first and second molding spaces between the forms and insulating layer. As a result of the form locking means acting in conjunction with the form retention segments, the forms are substantially rigidly held in place relative to the insulating layer.

After the concrete or the other hardenable material has hardened, the casting forms are removed to expose the composite wall structure. The casting form ties may then be pulled or pushed out of the composite wall by, for example, striking the protruding form retention segment with a hammer or chisel and/or pulling the opposite end with pliers or another suitable tool. Because the elongate sleeve tie covers the portion of the metal connector tie extending through the composite wall, the casting form tie is easily removed.

The elongate sleeve body is preferably formed from a material having a high thermal resistance, which results in highly insulative composite wall structures. For example, the body or a portion thereof can be formed from high strength resins or other thermoplastics or thermosetting plastics. Examples include at least one of polyamide, a polyarylsulfone, a polycarbonate, a polyphthalamide, a polysulfone, a polyphenylsulfone, a polyethersulfone, an aliphatic polyketone, an acrylic, polyethylene, polypropylene, an acrylonitrile-butadiene-styrene copolymer, a polyfluorocarbon, polybutadiene, polybutylene teraphthalate, a polyester, polyethylene teraphthalate, a polyphenylene ether, a polyphenylene oxide, a polyphenylene sulfide, a polyphthalate carbonate, polystyrene, polyurethane, polyvinyl chloride, polyxylene, a vinyl ester, a diallyl phthalate, an epoxy resin, a furan resin, a phenolic resin, or an alloy comprising two or more of the foregoing. The sleeve body may be injection molded as one or two parts. If molded as two parts the parts may be assembled into a single piece.

Depending on the desired structural properties of the composite wall structures, the sleeves may be used in combination with reinforcement materials used to strengthen the structural layers. For example, rebar, wire mesh, fibers, and the like may be attached to notches, hooks, or other reinforcement securing means formed on the sleeves.

In summary, the elongate sleeve ties provide composite action to the composite wall, tie the two wythes of concrete and insulating layer together, hold the insulation layer in place during manufacture of the composite wall, enable removal and reuse of the casting form ties. The sleeve ties optionally provide reinforcement securing means for any reinforcement materials, provide attachment locations for nails, screws, bolts, or other attachments into the composite wall, and provide a seal against moisture once the metal connector ties are removed from the sleeves.

These and other benefits, advantages and features of the present invention will become more fully apparent from the following description and appended claims, or may be learned by the practice of the invention as set forth hereinafter.

BRIEF DESCRIPTION OF THE DRAWINGS

In order that the manner in which the above recited and other benefits, advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

I. Introduction

Figure 1:
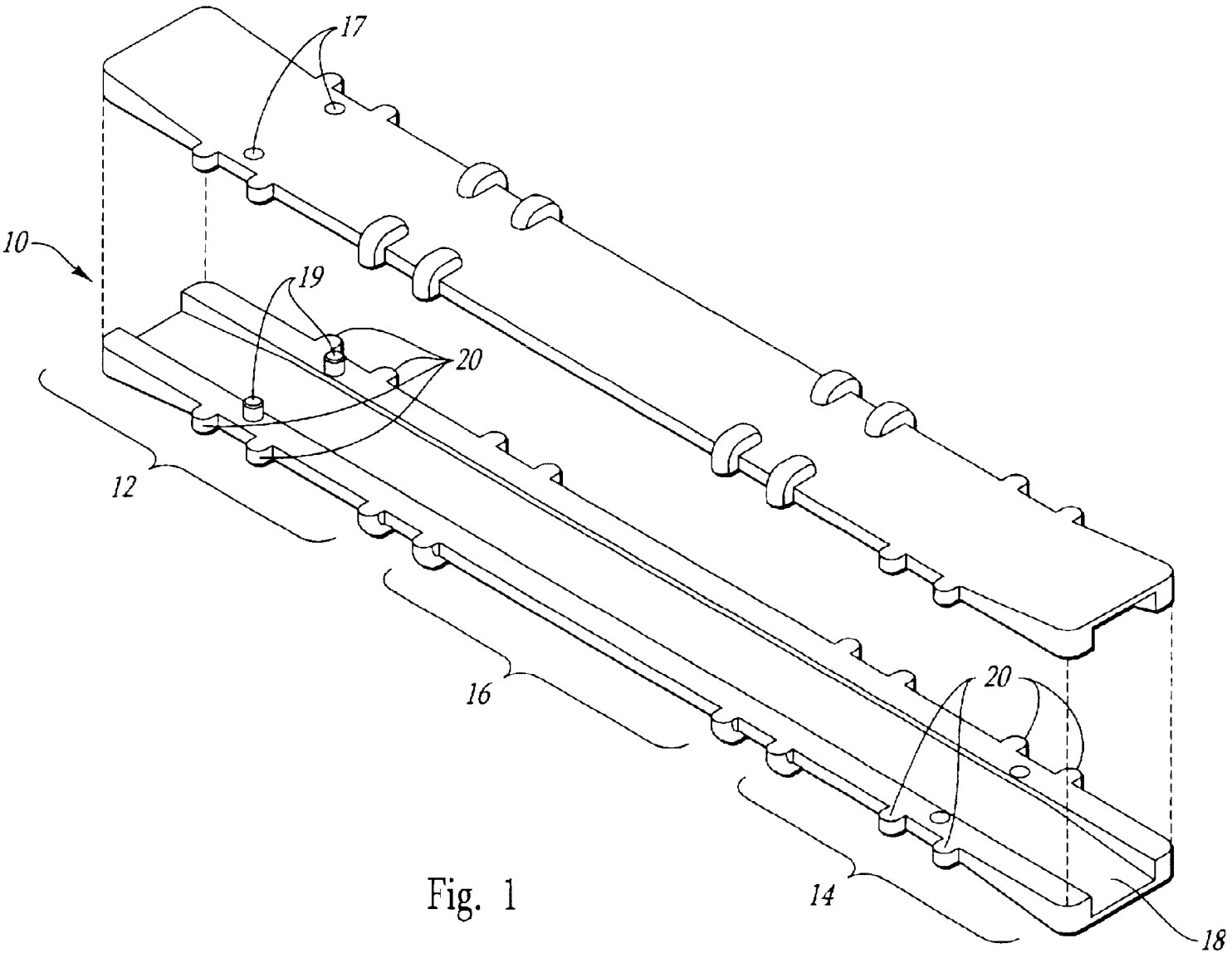
FIG. 1 is an exploded assembly view of an exemplary two-part elongate sleeve tie.

A detailed description of the invention will now be provided with specific reference to Figures illustrating preferred embodiments of the invention. It will be appreciated that like structures will be provided with like reference designations. To provide context for interpreting the scope of the invention, certain terms used throughout the application will now be defined.

As used herein, the various segments of the elongate sleeve body and casting form tie are defined according to the portion of the composite wall structure in which they may be positioned. In particular, the first anchor segment and the second anchor segment are defined as the elongate sleeve body portions that reside within structural layers of the final composite wall. The first anchor segment is disposed in a structural layer on one side of the insulating layer of the composite wall structure, while the second anchor segment is disposed in another structural layer on the opposite side of the insulating layer. Likewise, the mesial segment is defined as the elongate sleeve body portion that resides within the insulating layer of the composite wall structure. The central portion of the casting form tie is defined as the portion covered by the elongate sleeve body that resides within the composite wall structure.

The present invention is directed to an elongate sleeve tie designed to receive a casting form tie for use in the manufacture of a composite wall structure. During the manufacture of a composite wall structure, the casting form ties rigidly secure casting forms in a spaced-apart relation on either side of the insulating layer. At least a portion of the casting form tie is received by a central recess formed in the elongate sleeve body. As concrete or other hardenable material is poured into the spaces between the insulating layer and the casting forms, the casting form ties (covered by the elongate sleeve ties) prevent the unhardened material from pushing the casting forms out of position. Once the composite wall has been formed, the casting form ties may be pulled or pushed out of the wall, leaving the elongate sleeve ties in place. At least a portion of the elongate sleeve body is formed of a material having a high thermal resistance.

The elongate sleeve tie comprises an elongate sleeve body that includes a first anchor segment, a second anchor segment, and a mesial segment therebetween. The sleeve also includes a central recess configured to receive a casting form tie, which recess is oriented longitudinally through the anchor and mesial segments. The mesial segment and preferably the anchor segments are formed of a material having a high thermal resistance.

Casting form ties are typically formed of metal, although other materials may also be used. Casting form ties generally include form retention segments disposed at each end of the tie. A central segment of the tie connects the opposite form retention segments. The elongate sleeve body is designed to be positioned over the central segment of the casting tie, fitting the tie in the central recess of the sleeve body. The form retention segments of the casting tie remain exposed (i.e. they are preferably not covered by the elongate sleeve body. In the composite wall structure set-up structure, prior to pouring structural material between the casting forms, the mesial segment of the sleeve body will extend through the insulating layer and the form retention segments of the casting tie will extend through holes in the casting forms. The anchor segments of the sleeve body will reside substantially within first and second molding spaces defined by the insulating layer and casting forms. The sleeve body preferably has a length such that the ends of the sleeve body bear against the inside surface of the casting forms during manufacture of the composite wall structure. The form retention segments of the casting form ties extend through and beyond the outside surface of the casting forms so that they may be locked to the form. Locking the casting tie to the casting forms inhibits outward lateral movement of the forms once the casting form tie covered by an elongate sleeve body has been locked in place.

When the concrete or other hardenable material has been poured and cured, the casting forms are removed from the composite wall, leaving the form retention segments of the casting form ties protruding from the surface of the composite wall. The protruding form retention segments allow a person to remove the casting form ties either by pulling or pushing them out of the composite wall. This may be accomplished by striking them with a hammer or a chisel or by pulling them with pliers or some other suitable tool. When removing the casting form ties, the elongate sleeve ties remain integrally positioned within the composite wall structure. The elongate sleeve facilitates removal of the casting form tie because the sleeve body covers the central segment of the casting form tie residing within the composite wall, allowing it to be removed through the sleeve body.

The elongate sleeve tie preferably includes means for anchoring the sleeve tie within the hardened layer of structural material. Anchoring means may include a recess, a protrusion, or a textured surface formed on at least one of the first and second anchor segments. Moreover, at least a portion of the sleeve ties are formed from an insulative material so as to maintain good thermal resistance across the composite wall structure.

II. An Exemplary Elongate Sleeve Tie

Referring to FIG. 1, in a preferred configuration of an elongate sleeve tie of the present invention, the sleeve tie 10 includes a first anchor segment 12, a second anchor segment 14, and a mesial segment 16. These segments 12, 14, and 16 form the sleeve body. As illustrated, the sleeve body of sleeve tie 10 may be formed of two molded parts or halves that can be releasably joined together. In such an embodiment, each tie half body includes a trough that forms part of the central recess 18 when the two halves are joined together. Alternatively, the sleeve tie 10 may be manufactured as a single piece.

When manufactured as two molded halves, each tie half body includes at least one mating recess 17 or protrusion 19 configured to mate with a corresponding mating recess or protrusion in another tie half body in order to releasably join two tie half bodies together to form an elongate sleeve body, as seen in FIG. 1.

A. Anchor Segments

Anchor segments 12 and 14 form the ends of elongate sleeve tie 10. When sleeve tie 10 is used in a composite wall structure, one function of the sleeve tie is to tie together the structural layers and the insulating layer. Protrusions 20, which are formed in first anchor segment 12 and second anchor segment 14, are one example of anchoring means for mechanically locking the sleeve tie within a structural layer of the composite wall structure. The protrusions 20 provide a region around which unhardened concrete or other hardenable material can flow during formation of the structural layer. Once the hardenable material has hardened, the portion of the material positioned surrounding protrusions 20 mechanically prevents axial motion of sleeve tie 10 so that the sleeve tie resists being retracted from, or driven further through, the composite wall structure.

At least one of anchor segments 12 and 14 may be flared or tapered at the ends, which flaring acts as further anchoring means. Flaring the ends is an example of a structure that provides mechanical interference or interlocking between the sleeve and the structural layer when a force is applied that would otherwise tend to retract the sleeve from the structural layer.

A further example of anchoring means includes an adhesion means for promoting improved adhesion or bonding between at least one of the anchor segments and the hardened layer of structural material. Examples of adhesion means include an adhesive, a partially cured thermoset resin, or a solvent capable of softening a portion of the elongate sleeve body when applied thereto. Suitable solvents that can be used for this purpose include, but are not limited to, methyl ethyl ketone, cylclohexanone, tetrahydrofuran, acetone, ethyl acetate, methyl alcohol, and the like.

It has even been found that elongate sleeve ties having no special mechanical features for anchoring and which have not been treated with any adhesion promoting materials can nevertheless form an adequate bond between the anchor segments and hardened structural materials such as concrete. It has been found that the inherent bond between the elongate sleeve ties and concrete is adequate in many cases to firmly retain the anchoring segments of the sleeve body within the respective structural layers. Although there might be some tendency for the sleeve ties to experience a pull-out effect prior to failure, there will be no actual pull-out depending on the frequency of sleeve ties within the composite wall structure. So long as the cumulative strength of the bonds of the sleeve ties within a particular region are stronger than the forces exerted by relative movement of the structural layers, there will be little if any pull-out of the sleeve ties in many cases. Moreover, whereas it may be desirable for at least some of the sleeve ties to be firmly mechanically anchored within the structural layers, it may be desirable to allow a portion of the sleeve ties to have some pull-out effect in order to allow a degree of relative movement, such as by thermal expansion or contraction of the structural layers. One of ordinary skill in the art will know whether or not particular sleeve ties will likely experience a pull-out effect and will be able to know beforehand whether or not such pull-out is desired or should be prevented.

B. Mesial Segment

Figure 2:
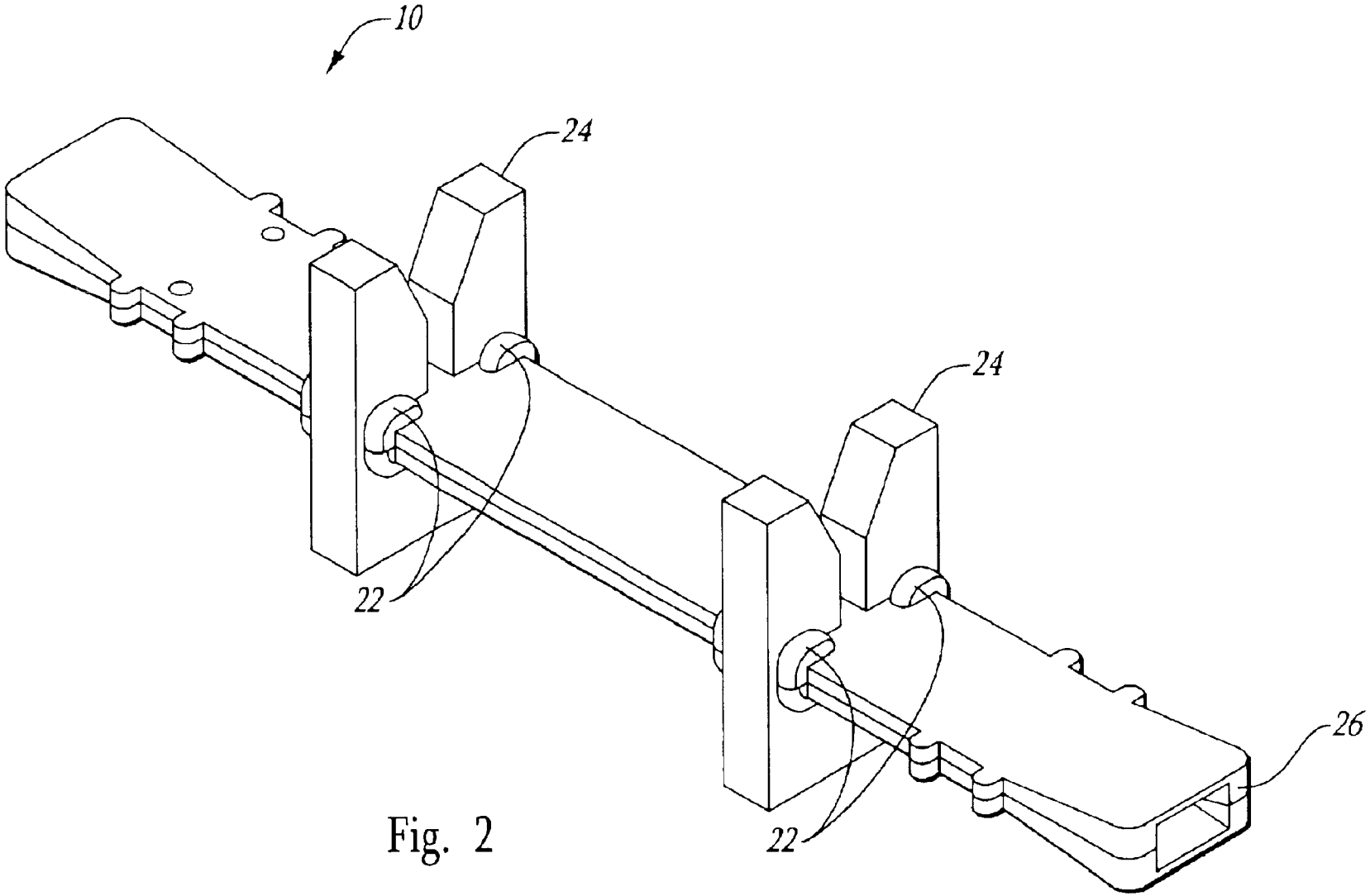
FIG. 2 illustrates an exemplary assembled elongate sleeve tie with optional retaining brackets.

Mesial segment 16 of elongate sleeve tie 10 is disposed between first and second anchor segments 12 and 14. When the composite wall is complete, mesial segment 16 resides in the insulating layer of the composite wall. Referring to FIG. 2, elongate sleeve tie 10 may optionally include protrusions 22 positioned at each end of mesial segment 16. Protrusions 22 are configured so as to receive between them a retention bracket 24. Retention bracket 24 maintains the insulating layer in a desired position by preventing significant movement of the insulating layer relative to the elongate sleeve body in either axial direction. The retention brackets positioned at each end of the mesial segment provide a bearing surface contacting the insulating layer when the sleeve tie 10 is used in a composite wall structure.

C. Central Recess

Elongate sleeve tie 10 also includes a central recess 18 that is formed longitudinally through anchor segments 12 and 14 and through mesial segment 16. Recess 18 is configured to receive therein a casting form tie. The recess 18 is preferably slightly flared to match any flaring of the ends 26 of the sleeve tie 10. Flaring the recess 18 at the ends 26 facilitates insertion and removal of the casting form tie in and out of the sleeve tie 10, provides a receiving area for a caulk or rubber plug to prevent moisture from entering once the ties are removed, and provides a convenient site for nails, screws, bolts, or other attachments to anchor into the finished composite wall.

D. Materials

At least a portion of the elongate sleeve tie of the invention is preferably formed from a relatively highly insulative, or high R value, thermoplastic or thermoset material. Glass fibers or other materials may be added as desired. Thus, when the sleeve ties are used in composite wall structures, the flow of thermal energy through the sleeve ties is minimized, or at least greatly reduced, so that the composite wall structures are relatively highly insulative. One thermoplastic material that is presently preferred is glass fiber reinforced polyphthalamide resin due to its resistance to alkaline chemicals and the high degree of composite action acheived.

Other preferred thermoplastic materials (whether filled or unfilled) having a relatively high thermal resistance include polyamides, polyarylsulfones, polycarbonates, polyphthalamides, polysulfones, polyphenylsulfones, polyethersulfones, and aliphatic polyketones. Less preferred thermoplastics that are nevertheless adequate for most applications include acrylics, polyethylene, polypropylene, acrylonitrile-butadiene-styrene copolymers, polyfluorocarbons, polybutadienes, polybutylene teraphthalates, polyesters, polyethylene teraphthalates, polyphenylene ethers, polyphenylene oxides, polyphenylene sulfides, polyphthalate carbonates, polypropylenes, polystyrenes, polyurethanes, polyvinyl chlorides, and polyxylenes.

Preferred thermoset resins include polyester and vinyl esters. Other suitable thermoset materials include diallyl phthalates, epoxy resins, furan resins, and phenolic resins. The foregoing lists are illustrative and not limiting. In addition, copolymers and combinations of the foregoing materials may be used. The criteria used to select the material include sufficient strength and flexibility in order to avoid failure, a sufficiently high R value such that the composite wall structure is adequately insulative, cost, and moldability.

Depending on the particular plastic or resin used to form at least a portion of the elongate sleeve body and the desired structural properties of the finished product, reinforcing fibers such as glass fibers, carbon fibers, boron fibers, ceramic fibers, cellulose fibers, nylon fibers, other polymeric fibers and the like may be interspersed within the material in order to increase the composite action of the resulting composite wall.

The elongate sleeve body is preferably formed by injection molding in a single step or, alternatively, by a small number of steps that preferably include an injection molding step. Optionally, the injection molding step may be replaced by resin transfer molding, reaction injection molding, or any other single-step or relatively simple molding process. An important criterion is that the costs of the molding process be commensurate with the overall cost parameters of the elongate sleeve body and tie that is to be formed. Using injection molding of resins or plastics provides sleeve ties having adequate tensile, shear, and bending strength, and has the benefit of being relatively cost-effective.

III. Casting Form Ties

Figure 3:
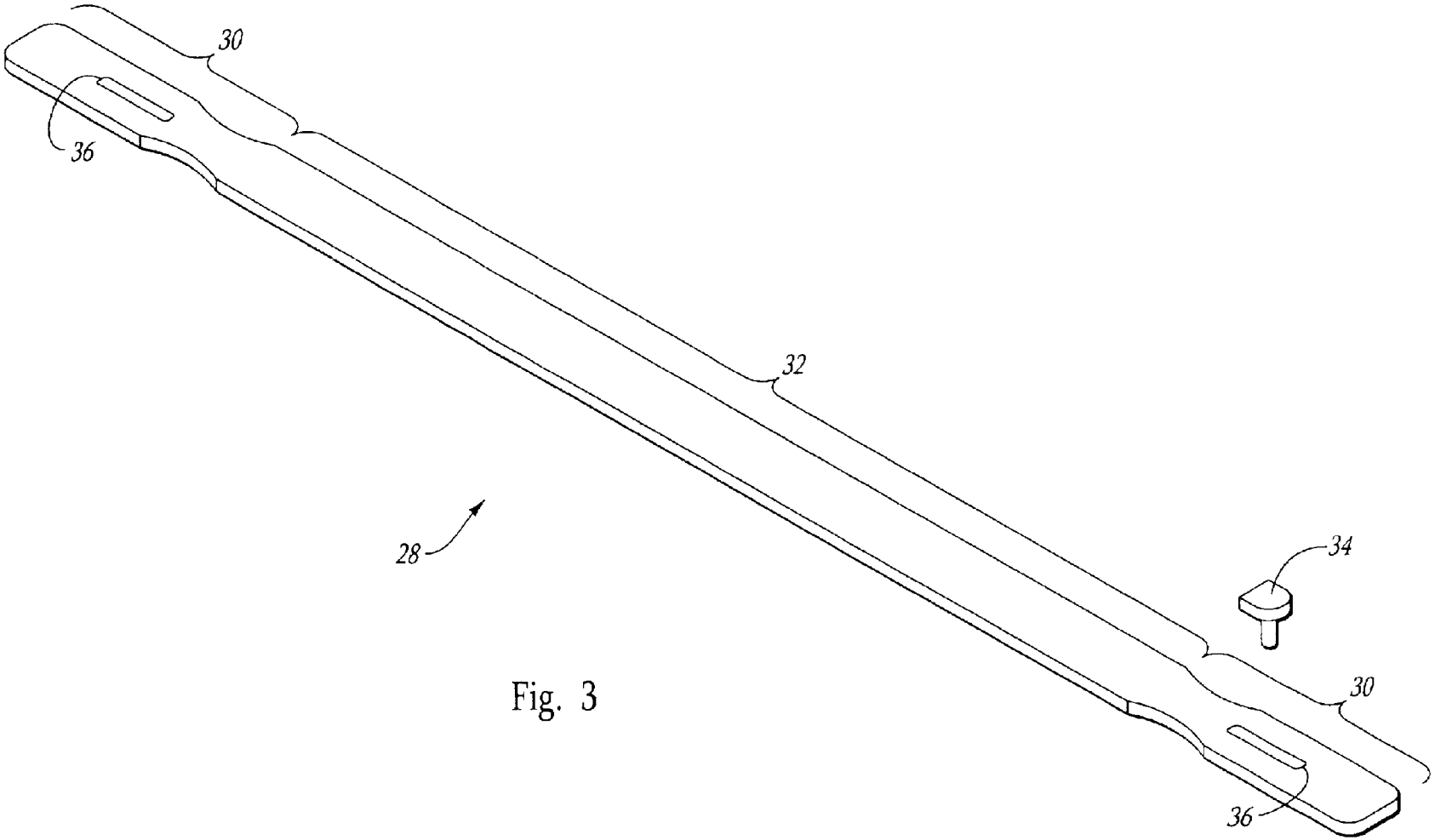
FIG. 3 illustrates an exemplary casting form tie.

Referring to FIG. 3, casting form tie 28 generally includes two form locking segments 30 and a central segment 32. When used with an elongate sleeve tie of the present invention, the sleeve body covers the central segment 32 of the casting tie 28. When positioned for use in the formation of a composite wall, central segment 32 covered by the sleeve body of sleeve tie 10 resides in the insulating and structural layers of the composite wall. The form locking segments 30 are preferably not covered by the sleeve body, but protrude from the casting forms used in formation of the composite wall. The form locking segments 30 include form locking means for substantially preventing lateral outward motion of the casting forms, while the abutting elongate sleeve body may prevent lateral inward motion of the casting form. One example of a form locking means is pin 34. In order to allow the form locking means to securely abut the forms, the form retention segment 30 includes a hole 36 passing through form retention segment 30. It should be understood that virtually any structure that can mechanically interact with and prevent undesired movement of the casting forms, may comprise form locking means. Nonexclusive examples include pins, screws, nuts, washers, flanges, brackets, and even resins, glues and other initially flowable materials that can solidify to form a barrier to movement of the forms relative to the casting form ties.

Figure 4A:
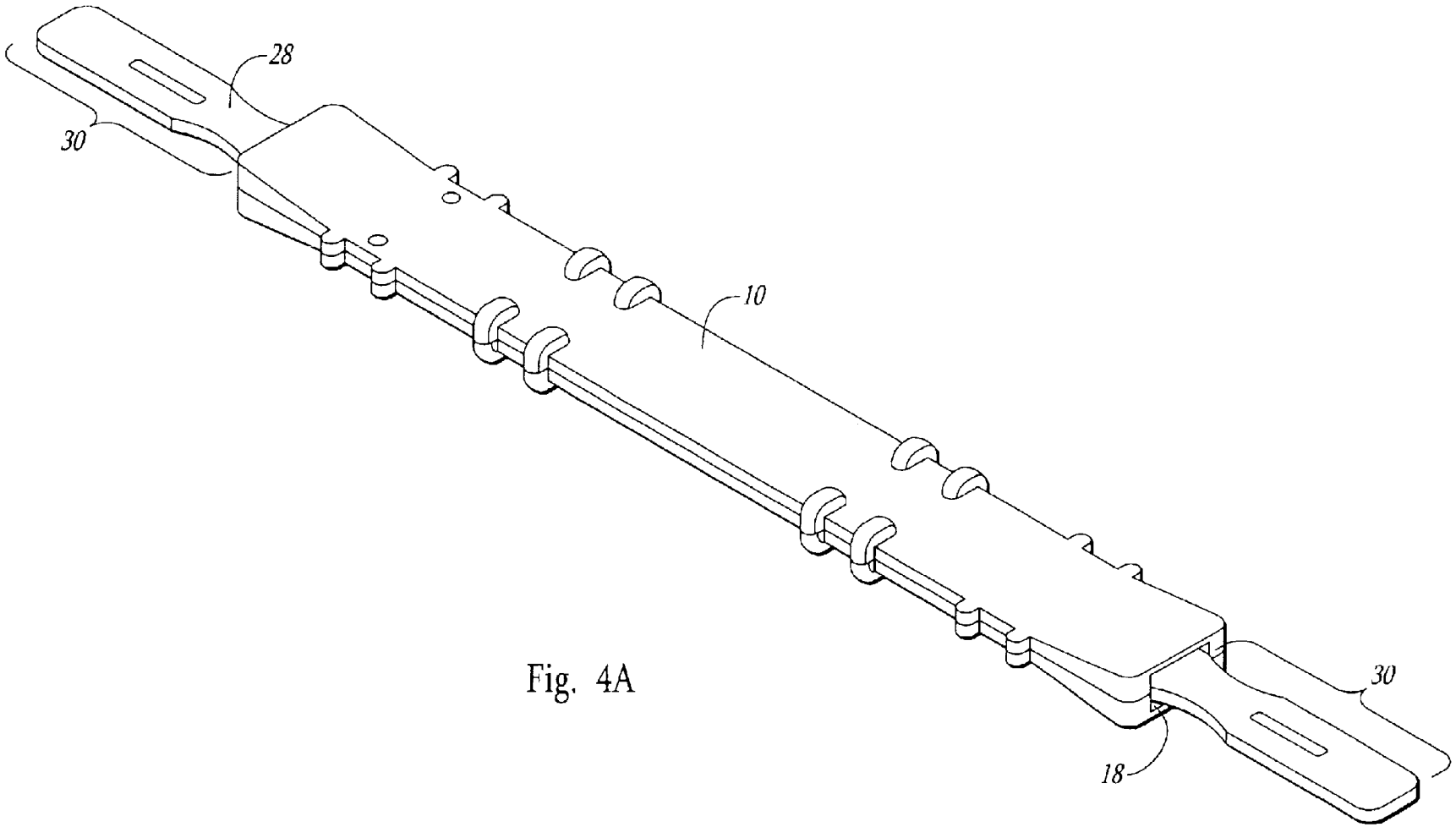
FIG. 4A is a perspective view of an exemplary elongate sleeve tie and a casting form tie at least partially received within the central recess of the elongate sleeve tie.

FIG. 4A illustrates an elongate sleeve tie 10 and a casting form tie 28, where the casting form tie is received within the central recess 18 of sleeve tie 10. As can be seen, the central segment 32 of the casting form tie is covered by the sleeve body of sleeve 10, while form locking segments 30 remain uncovered.

Figure 4B:
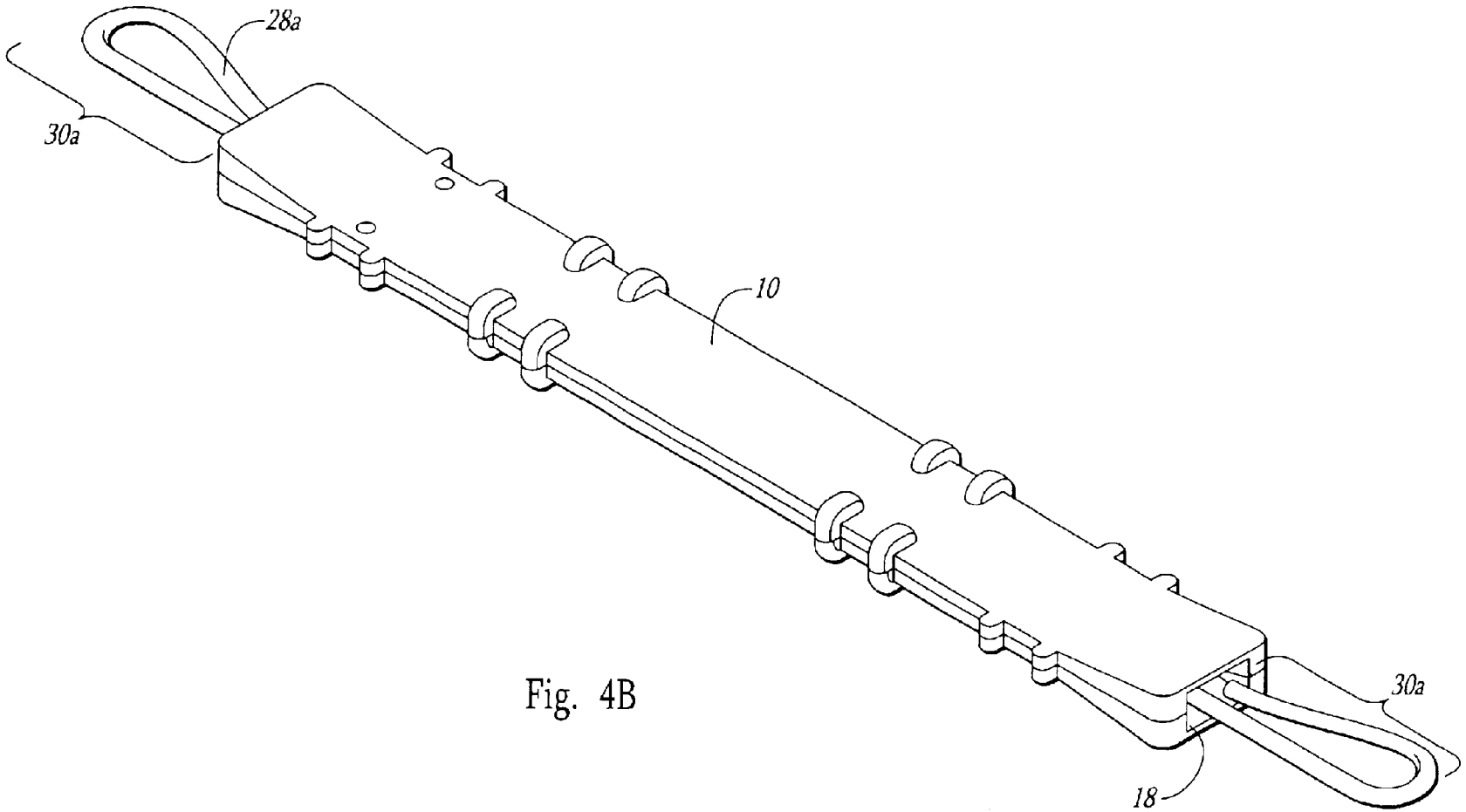
FIGS. 4B–4C are perspective views of exemplary elongate sleeve ties with an alternative casting form tie at least partially received within the central recess of the elongate sleeve tie.

FIG. 4B illustrates elongate sleeve tie 10 and a looped casting form tie 28*a*, where the casting form tie 28*a* is received within the central recess 18 of sleeve tie 10. As can be seen, a central segment of the casting form tie 28*a* is covered by the sleeve body of sleeve 10, while form locking segments 30*a* remain uncovered.

Figure 4C:
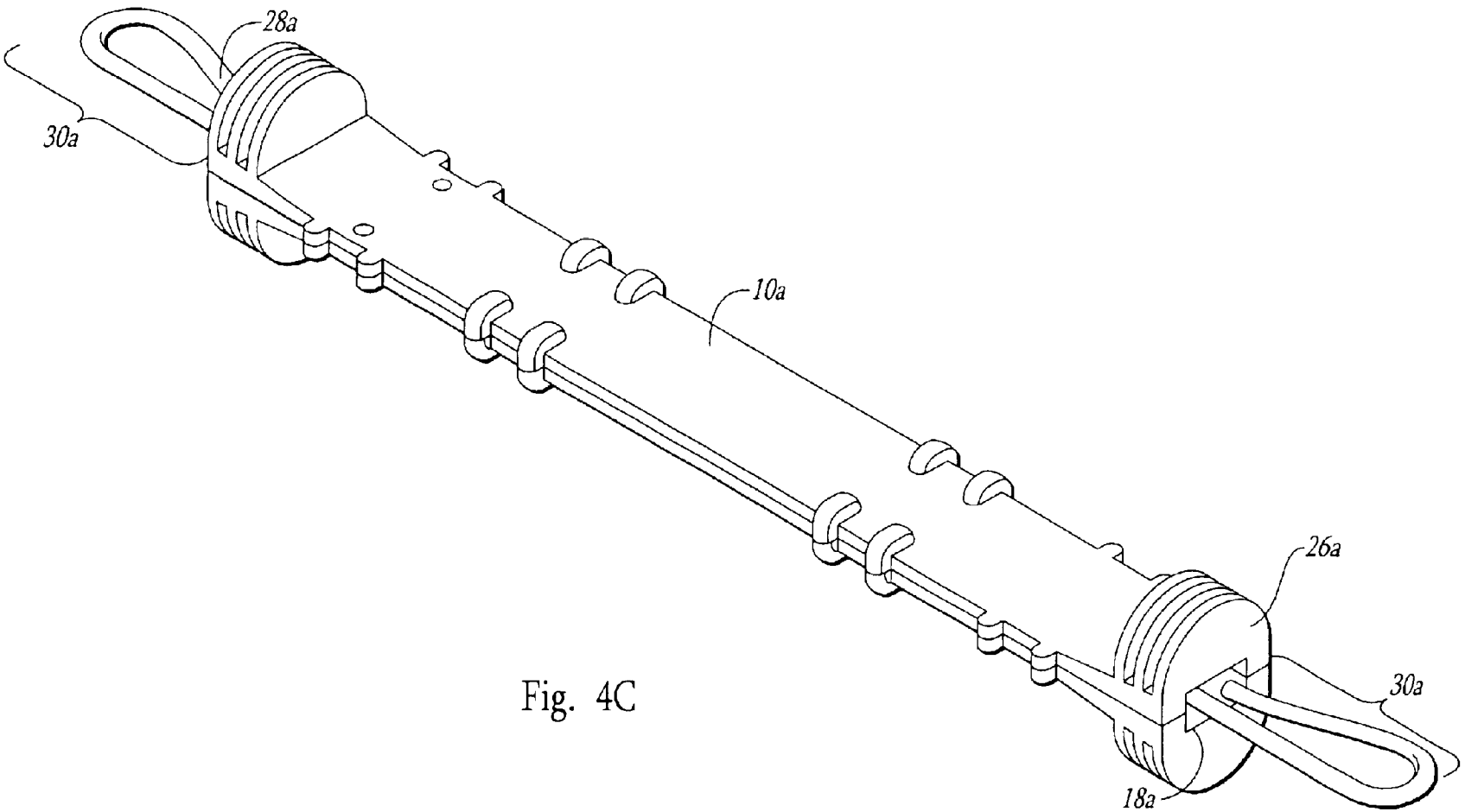

FIG. 4C illustrates an alternative embodiment of an elongate sleeve tie 10*a*, with a looped casting form tie 28*a*, where the casting form tie 28*a* is received within the central recess 18*a* of sleeve tie 10*a*. As can be seen, a central segment of the casting form tie 28*a* is covered by the sleeve body of sleeve 10*a*, while form locking segments 30*a* remain uncovered. Sleeve tie 10*a* includes enlarged targets 26*a* molded at the ends of sleeve 10*a*. Enlarged targets 26*a* are useful for attachment of nails or screws to the finished composite wall, for example to accommodate attachment of drywall, etc.

IV. Method of Use

The elongate sleeve tie and casting form tie are used in the formation of composite walls. Composite wall structures incorporating the sleeves ties and casting form ties disclosed herein and methods for forming the composite wall structures may be understood by making reference to FIGS. 5A, 5B, and 6. In particular, these Figures illustrate a composite wall structure that is formed according to the "cast-in-place" method. Although the following description uses elongate sleeve tie 10 and casting form tie 28, it is to be understood that alternative sleeves 10*a* and 10*b*, along with alternative casting form tie 28*a*, or any other sleeve or casting form tie, could be used.

Figure 5A:
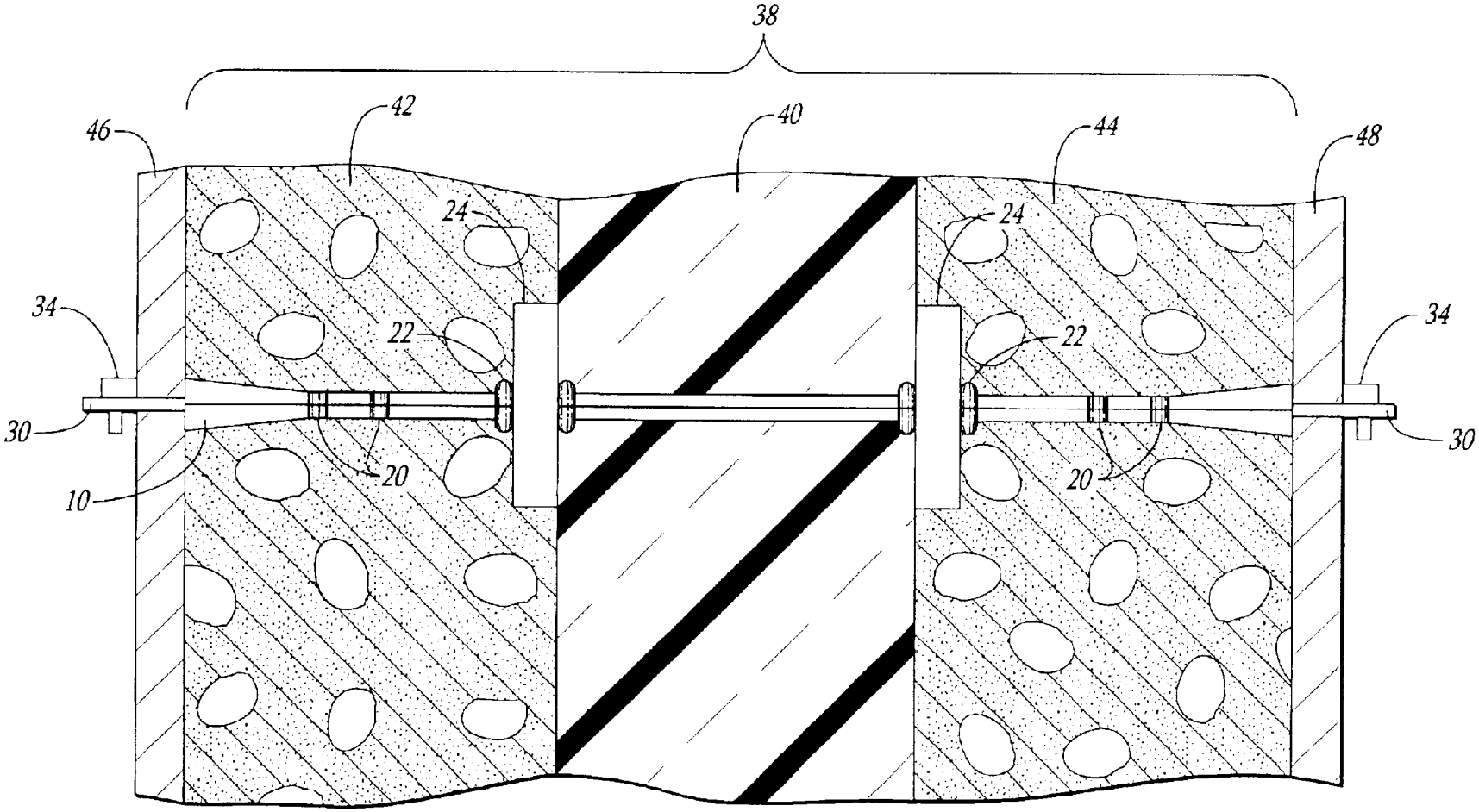
FIG. 5A is a transverse cross sectional view of an exemplary composite wall structure being formed using the cast in place method, using the elongate sleeve tie and casting form tie of FIG. 4A.

FIG. 5A is a transverse cross-sectional elevation view of a composite wall structure 38 having an insulating layer 40 positioned between a first structural layer 42 and a second structural layer 44. Composite wall structures incorporating elongate sleeve ties 10 disclosed herein are most conveniently constructed using the cast-in-place method, although other known techniques may instead be used. In one embodiment, the composite wall structure 38 may be used as a structural wall of a commercial or residential building. Insulating layer 40 may be a panel formed from any of a wide variety of highly insulative materials that can be used in construction applications. Examples of suitable insulative materials include, but are not limited to, polystyrene foam, fiberglass, aerogel, xerogel, xonotlite, seagel, polyisocyanate foam, polyurethane foam, urea-formaldehyde foam, insulating cementitious materials, and mixtures of the foregoing.

In the cast-in-place method, insulating layer 40 and casting forms 46 and 48 are substantially vertically oriented, on a footing or otherwise, to form a set-up structure, preferably at or near where the composite wall structure 38 is to be finally situated. The casting forms and insulating layer are preferably positioned so as to define molding spaces between the forms and insulating layer into which a hardenable structural material (e.g. concrete) may be introduced. Forms 46 and 48 may comprise any suitable rigid panel formed from a material having a desired mechanical strength. A plurality of holes may be formed through insulating layer 40 and forms 46 and 48 at the locations where sleeve ties 10 and casting form ties 28 are to pass through. According to one method, the holes are formed by advancing a drill bit of sufficient length consecutively through one of the forms 46 or 48, insulating layer 40, and the other of forms 46 or 48. Forming the holes in this manner ensures that the holes are properly aligned for receiving sleeve tie 10 and casting form tie 28. Alternatively, the holes may be individually formed, either before or after forms 46 and 48 and insulating layer 40 have been vertically oriented, although this may increase the effort required to align the holes.

Figure 5B:
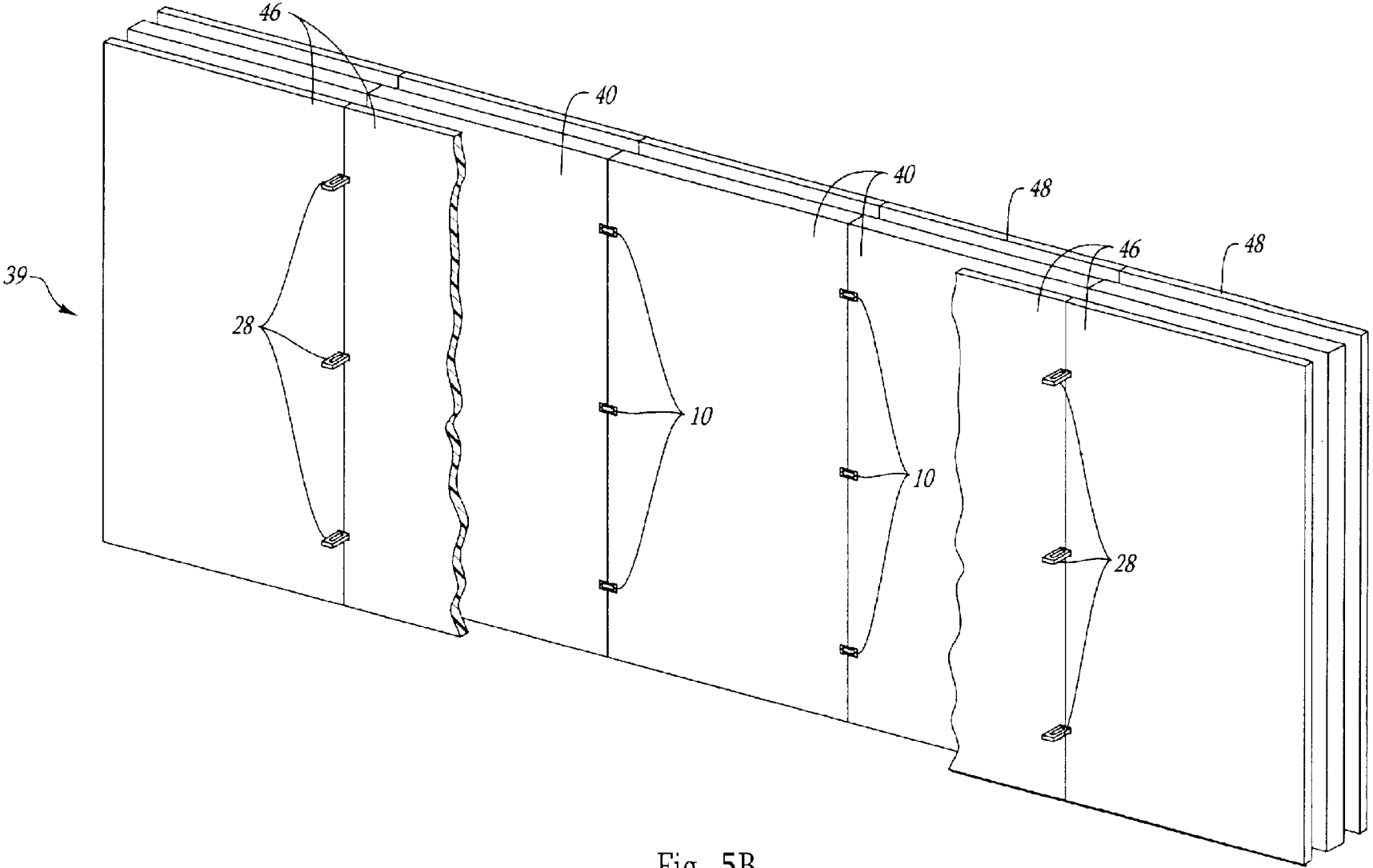
FIG. 5B is a longitudinal cross sectional view of an exemplary composite wall structure being formed using the cast in place method, using the elongate sleeve tie and casting form tie illustrated in FIG. 4A.

Referring to FIG. 5B, in a preferred set up structure 39, the insulating layer 40 and casting forms 46 and 48 may be provided in desired widths (e.g. two or three feet). Each width (whether casting form or insulating layer) may be provided with a plurality of notches at the abutting ends of the individual widths, that when abutted together form a hole through which sleeve ties 10 and casting form ties 28 may be inserted. The sleeve ties 10 and casting form ties 28 are placed so as to be received through the holes formed at the abutment of individual widths of the casting forms and the insulating layer along the length of set up structure 39. FIG. 5B illustrates a length of set up structure 39 with a cut away portion into the center of set up structure 39 so as to see insulation layer 40. In the cut away center portion of set up structure 39 are seen sleeve ties 10 received in notched individual panels of insulation layer 40. The protruding portions of sleeve ties 10 and casting form ties 28 are not shown so as to better illustrate the details of set up structure 39.

The number of sleeve ties 10 and casting form ties 28 used in any of the embodiments disclosed herein should be sufficient to reliably bear the force directed onto the casting forms by the uncured concrete. The number and spacing of sleeve ties and casting form ties will depend on the dimensions and mechanical properties of the materials and on the size and mechanical requirements of the composite wall that is to be constructed.

Sleeve ties 10 and casting form ties 28 assembled as in FIG. 4A are inserted through the holes until positioned substantially as illustrated in FIGS. 5A and 5B. In order to further secure the insulating layer in the desired position retaining brackets 24 may be advantageously snapped into place between protrusions 22. Depending on the desired structural properties of the composite wall structure, reinforcement materials such as rebar, metal cables, wires, natural and synthetic organic fibers, metal fibers, wire mesh, and the like can be secured in place by reinforcement securing means. Protrusions 20 are an example of a reinforcement securing means. Notches, hooks, or other suitable structures optionally formed on the sleeve body of sleeve tie 10 may alternatively be substituted for protrusions 20.

Pins 34 or other form locking means are then attached to the corresponding form retention segments 30, thereby preventing subsequent outward displacement of forms 46 and 48. Concrete is poured within the first and second molding spaces on either side of the insulating layer 40 to form first structural layer 42 and second structural layer 44. Alternatively, any of a number of other suitable hardenable structural materials may be used in place of concrete in this and other embodiments of the invention.

In order to avoid unduly stressing one side of the insulating layer 40 during formation of the structural layers 42 and 44, it is usually preferable to pour roughly equal depths of concrete within the molding spaces in order to substantially equalize the pressure being exerted on either side of the insulating layer 40 at any particular moment. The bearing surfaces of pins 34 and sleeve ties 10 prevent such displacement as has been described herein.

After the composite wall structure of FIG. 5A has been formed, the forms 46 and 48 arm preferably removed from the adjacent structural layers. In order to remove the forms, the form locking means must be generally removed from the casting form ties 28, either by separating them from the form retention segments 30 or by breaking or cutting off at least a portion of the form locking means, and perhaps part of the form retention segment, to release the forms. For example, in FIG. 5A, pins 34 may be removed from the respective holes in form retention segments 30, thus allowing the forms to be pulled away from the composite wall structure 38.

Figure 6:
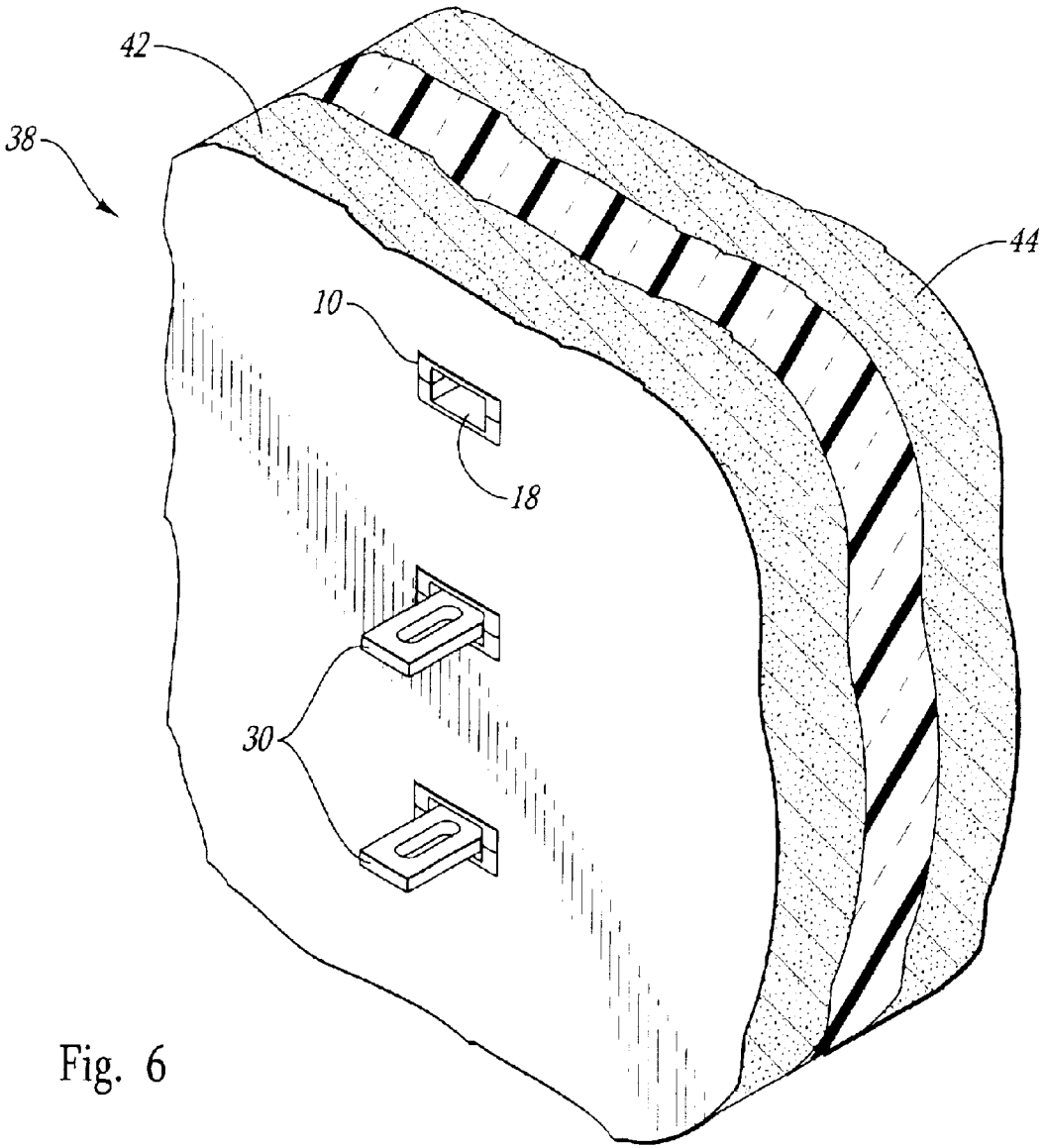
FIG. 6 is a partial perspective view of an exemplary composite wall structure formed according to the invention, showing form retention segments of two casting form ties extending beyond the surface of a structural layer and a third casting form tie having been removed from the composite wall.

FIG. 6 illustrates composite wall structure 38 in perspective view with forms 46 and 48 having been removed therefrom, leaving form retention segments 30 of casting form ties 28 extending from the outer surface of first structural layer 42. In order to eliminate the thermal bridges resulting from metal casting form ties 28 and provide a reasonably smooth outer surface of first structural layer 42, casting form ties 28 are removed from composite wall 38. In FIG. 6, the casting form tie 28 that was positioned inside the uppermost illustrated sleeve 10 has been removed from the sleeve and composite wall. Removal of casting form ties 28 may be accomplished by striking protruding form retention segment 30 with a hammer and/or chisel so as to cause casting tie 28 to slide out of the composite wall 38 through the sleeve body of sleeve tie 10. Alternatively, other tools such as pliers, and the like may be used to pull casting ties 28 from composite wall 38. It is to be understood that opposite form retention segments 30 ordinarily also protrude from the outer surface of second structural layer 44, which is not visible in FIG. 6. Once the casting ties 28 have been removed, the central recess 18 of each sleeve body may be filled with a caulk or rubber plug to prevent moisture from entering the recess. The plug and recess also provides a convenient anchoring site for nails, screws, bolts, and other attachments.

It will also be appreciated that the present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An elongate sleeve tie designed to receive a casting form tie for use in manufacturing a composite wall structure comprising an insulating layer sandwiched between first and second structural layers, the elongate sleeve tie comprising an elongate sleeve body formed from a material having high thermal resistance, said elongate sleeve body comprising:

a mesial segment positionable through a passage within an insulating layer when the insulating layer is in a desired spaced-apart relationship between two casting forms used to manufacture a composite wall structure;

a first anchor segment adjacent to a first side of the mesial segment and positionable within a first space between the insulating layer and a first casting form for placement of a first layer of a hardenable structural material within the first space during manufacture of a composite wall structure;

a second anchor segment adjacent to a second side of the mesial segment and positionable within a second space between the insulating layer and a second casting form for placement of a second layer of a hardenable structural material within the second space during manufacture of a composite wall structure, wherein at least one of said first and second anchor segments further comprises means for anchoring said elongate sleeve tie within a hardened layer of structural material; and a central recess configured to receive therein a casting form tie used to connect first and second casting forms together during manufacture of a composite wall structure.

2. An elongate sleeve tie as recited in claim 1, wherein said anchoring means comprises at least one of a recess, a protrusion, or a textured surface.

3. An elongate sleeve tie as recited in claim 1, wherein said anchoring means comprises adhesion means for promoting improved adhesion or bonding between at least one of said first and second anchor segments and a hardened layer of structural material.

4. An elongate sleeve tie as recited in claim 3, wherein said adhesion means comprises at least one of an adhesive, a partially cured thermoset resin, or a solvent capable of softening a portion of said elongate sleeve body when applied thereto.

5. An elongate sleeve tie as recited in claim 1, wherein at least one of said first and second anchor segments is flared or tapered.

6. An elongate sleeve tie as recited in claim 1, further comprising at least one of a target or a plug for attachment of nails, screws, bolts, or other attachments to anchor into a finished composite wall.

7. An elongate sleeve tie as recited in claim 1, further comprising two retention brackets removably attached to said elongate sleeve body adjacent to either side of said mesial segment and which together prevent significant movement of an insulating layer relative to said elongate sleeve body in either axial direction.

8. An elongate sleeve tie as recited in claim 7, further comprising reinforcement securing means, disposed on said elongate sleeve body, for securing a reinforcement material in a fixed position relative to said elongate sleeve body during manufacture of a composite wall structure.

9. An elongate sleeve tie as recited in claim 1, wherein at least a portion of said elongate sleeve body is formed of at least one of polyamide, a polyarylsulfone, a polycarbonate, a polyphthalamide, a polysulfone, a polyphenylsulfone, a polyethersulfone, an aliphatic polyketone, an acrylic, polyethylene, polypropylene, an acrylonitrile-butadiene-styrene copolymer, a polyfluorocarbon, polybutadiene, polybutylene teraphthalate, a polyester, polyethylene teraphthalate, a polyphenylene ether, a polyphenylene oxide, a polyphenylene sulfide, a polyphthalate carbonate, polypropylene, polystyrene, polyurethane, polyvinyl chloride, polyxylene, a polyester, a vinyl ester, a diallyl phthalate, an epoxy resin, a furan resin, a phenolic resin, or an alloy comprising two or more of the foregoing.

10. An elongate sleeve tie as recited in claim 1, wherein said elongate sleeve body has a length equal to a desired space between two casting forms used to manufacture a composite wall structure in order that the ends of the elongate sleeve body bear against the casting forms during manufacture of the composite wall structure.

11. An elongate sleeve tie as recited in claim 1, wherein said elongate sleeve body comprises two halves that are releasably joined together, each of said halves including a trough that forms part of said central recess when the two halves are joined together.

12. A kit for use in manufacturing a composite wall structure, the kit comprising a plurality of elongate sleeve ties as defined in claim 1 and a plurality of corresponding casting form ties that are at least partially positionable within said central recess.

13. A kit as recited in claim 12, wherein at least some of said casting form ties comprise metal.

14. A kit as recited in claim 12, wherein said elongate sleeve body of at least some of the elongate sleeve ties comprises a pair or elongate tie half bodies that are releasably joined together, each of said tie half bodies including a trough that forms part of said central recess of said elongate sleeve body when the two tie half bodies are joined together.

15. A kit as recited in claim 14, wherein each tie half body comprises at least one of a mating recess or protrusion configured to mate with a corresponding mating recess or protrusion in another tie half body in order to releasably join two tie half bodies together to form said elongate sleeve body.

16. A device for use in manufacturing a composite wall structure, the device comprising an elongate sleeve tie as defined in claim 1 and a corresponding casting form tie at least partially received within said central recess of said elongate sleeve body.

17. A device as recited in claim 16, wherein said casting form tie comprises metal.

18. An elongate tie portion comprising:

an elongate tie half body formed from a material having high thermal resistance, said elongate tie half body comprising a trough and at least one of a mating recess or protrusion configured to mate with a corresponding mating recess or protrusion in another tie half body in order to releasably join two tie half bodies together to form an elongate sleeve body of an elongate sleeve tie for use in manufacturing a composite wall structure including an insulating layer sandwiched between first and second structural layers, the elongate sleeve body, when formed by joining two tie half bodies together, comprising:

a mesial segment positionable through a passage within an insulating layer when the insulating layer is in a desired spaced-apart relationship between two casting forms used to manufacture a composite wall structure;

a first anchor segment adjacent to a first side of the mesial segment and positionable within a first space between the insulating layer and a first casting form for placement of a first layer of a hardenable structural material within the first space during manufacture of a composite wall structure;

a second anchor segment adjacent to a second side of the mesial segment and positionable within a second space between the insulating layer and a second casting form for placement of a second layer of a hardenable structural material within the second space during manufacture of a composite wall structure; and a central recess configured to receive therein a casting form tie used to connect first and second casting forms together during manufacture of a composite wall structure.

19. A kit for use in manufacturing a composite wall structure, the kit comprising a plurality of elongate tie portions as defined in claim 18.

20. A kit as defined in claim 18, further comprising a plurality of corresponding casting form ties that are at least partially positionable within a central recess of an elongate sleeve body formed by joining together two of said elongate tie portions.

21. A method of manufacturing a composite wall structure, comprising:

erecting a first casting form;

inserting a plurality of casting form ties through corresponding holes in said first casting form and locking a first end of each casting form tie to said first casting form;

placing a plurality of elongate sleeve ties over each of said casting form ties, each elongate sleeve tie comprising an elongate sleeve body formed from a material having high thermal resistance, said elongate sleeve body comprising:

a mesial segment positionable through a passage within an insulating layer when the insulating layer is in a desired spaced-apart relationship between two casting forms used to manufacture a composite wall structure;

a first anchor segment adjacent to a first side of the mesial segment and positionable within a first space between the insulating layer and a first casting form for placement of a first layer of a hardenable structural material within the first space during manufacture of a composite wall structure;

a second anchor segment adjacent to a second side of the mesial segment and positionable within a second space between the insulating layer and a second casting form for placement of a second layer of a hardenable structural material within the second space during manufacture of a composite wall structure; and a central recess configured to receive therein a casting form tie used to connect first and second casting forms together during manufacture of a composite wall structure:

positing an insulating layer in a spaced-apart relationship relative to said first casting form so that said mesial segment of each elongate sleeve body is positioned at least partially within said insulating layer, so that a first space exists between said first casting form and said insulating layer, and so that said first anchor segment of each elongate sleeve body is positioned at least partially within said first space;

erecting a second casting form in a spaced-apart relationship relative to said insulating layer and locking a second end of each casting form tie to said second casting form so that a second space exists between said second casting form and said insulating layer and so that said second anchor segment of each elongate sleeve body is positioned at least partially within said second space;

introducing unhardened structural material into said first and second spaces;

allowing the unhardened structural material to harden in order to form a composite wall structure;

removing the said casting forms from the composite wall structure; and removing the casting form ties from the composite wall structure.

22. A set-up structure used in the manufacture of an insulating composite wall structure having an insulating layer disposed between a pair of structural layers, the set-up structure comprising:

first and second casting forms in a desired spaced-apart relationship defining a region therebetween;

an insulating layer at least partially disposed in the region between said casting forms, wherein said first casting form and said insulating layer define a first space therebetween into which a hardenable structural material can be introduced in order to form a first structural layer, wherein said second casting form and said insulating layer define a second space therebetween into which a hardenable structural material can be introduced in order to form a second structural layer;

a plurality of elongate sleeve ties as recited in claim 1 positioned in said region so that said mesial segment of each elongate sleeve tie is at least partially positioned within said insulating layer, said first anchor segment of each elongate sleeve tie is at least partially positioned within said first space, and said second anchor segment of each elongate sleeve tie is at least partially positioned within said second space; and a plurality of casting form ties, each passing through said central recess of said elongate sleeve body of a corresponding elongate sleeve tie, a first end of each casting form tie being locked to said first casting form and a second end of each casting form tie being locked to said second casting form.

23. An insulating composite wall structure, comprising:

a first structural layer comprising hardened concrete;

a second structural layer comprising hardened concrete;

an insulating layer disposed between the first and second structural layers; and a plurality of elongate sleeve ties as recited in claim 1 positioned in said composite wall structure so that mesial segment of each elongate sleeve tie is at least partially positioned within said insulating layer, said first anchor segment of each elongate sleeve tie is at least partially positioned within said first structural layer, and said second anchor segment of each elongate sleeve tie is at least partially positioned within said second structural segment.

* * * * *

UNITED STATES PATENT AND TRADEMARK OFFICE

CERTIFICATE OF CORRECTION

PATENT NO. : 6,854,229 B2
DATED : February 15, 2005
INVENTOR(S) : Keith et al.

It is certified that error appears in the above-identified patent and that said Letters Patent is hereby corrected as shown below:

Title page,
Item [56], References Cited, U.S. PATENT DOCUMENTS, change
"3,534,395 A 10/1970 Rogers" to
-- 5,523,359 A 8/1920 Rutter et al. --

Column 1,
Line 22, after "of such" remove "as"

Column 3,
Line 7, after "The first" remove "and"

Column 6,
Line 53, change "body." to -- body). --

Column 15,
Line 46, before "an insulating layer" change "positing" to -- positioning --

Signed and Sealed this

Twenty-eighth Day of June, 2005

JON W. DUDAS
*Director of the United States Patent and Trademark Office*